US008591001B2

(12) United States Patent
Aude

(10) Patent No.: US 8,591,001 B2
(45) Date of Patent: Nov. 26, 2013

(54) MULTICOLOR PRINTHEAD MAINTENANCE STATION

(75) Inventor: Olivier Aude, Marseilles (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/993,339

(22) PCT Filed: May 26, 2009

(86) PCT No.: PCT/EP2009/056356
§ 371 (c)(1),
(2), (4) Date: Mar. 7, 2012

(87) PCT Pub. No.: WO2009/144212
PCT Pub. Date: Dec. 3, 2009

(65) Prior Publication Data

US 2012/0176446 A1 Jul. 12, 2012

(30) Foreign Application Priority Data

May 29, 2008 (EP) ..... 08157149

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS 5,040,000 A 8/1991 Yokoi
5,602,573 A * 2/1997 Waschhauser et al. ..... 347/33

(Continued)

FOREIGN PATENT DOCUMENTS

EP 0 799 135 3/1999
EP 1972385 9/2008
WO WO 03/045697 6/2003

OTHER PUBLICATIONS

Morgavi, Paul, "The Challenge of Integration", 12th European Ink Jet Printing Conference, Barcelona, Oct. 2004.

(Continued)

*Primary Examiner* — Matthew Luu
*Assistant Examiner* — Alexander D Shenderov
(74) *Attorney, Agent, or Firm* — William R. Zimmerli

(57) ABSTRACT

A maintenance station apparatus for an ink jet printhead is provided. The printhead includes a plurality of jetting modules disposed side by side in a row and inclined relative to a direction of print media motion, each of the plurality of jetting modules including a nozzle face, each nozzle face including a first nozzle array configured to eject a first liquid and a second nozzle array configured to eject a second liquid. The maintenance station apparatus includes a wiping unit including a first wiper, a second wiper, and a wiper moving mechanism, the first wiper being associated with the first nozzle array of each jetting module and the second wiper being associated with the second nozzle array of each jetting module, and a capping unit including a plurality of cap pairs corresponding to the plurality of jetting modules, one cap of each cap pair being associated with the first nozzle array of the corresponding jetting module, the other cap of the cap pair being associated with the second nozzle array of the corresponding jetting module.

19 Claims, 10 Drawing Sheets

(56) References Cited

U.S. PATENT DOCUMENTS

| | | | | |
|---|---|---|---|---|
| 5,984,450 | A * | 11/1999 | Becker et al. | 347/24 |
| 6,183,059 | B1 | 2/2001 | Muhl et al. | |
| 6,460,968 | B1 * | 10/2002 | Chee et al. | 347/33 |
| 6,883,897 | B2 * | 4/2005 | Kinoshita et al. | 347/33 |
| 7,510,265 | B2 * | 3/2009 | Kang et al. | 347/33 |
| 2002/0071014 | A1 * | 6/2002 | Matsumoto et al. | 347/87 |
| 2002/0171707 | A1 * | 11/2002 | Ara | 347/33 |
| 2004/0212656 | A1 * | 10/2004 | Waller et al. | 347/33 |
| 2005/0062796 | A1 * | 3/2005 | Mott et al. | 347/33 |
| 2005/0072447 | A1 | 4/2005 | Aude | |
| 2005/0134634 | A1 * | 6/2005 | Tee et al. | 347/33 |
| 2005/0156996 | A1 * | 7/2005 | Sakurai | 347/33 |
| 2005/0248612 | A1 * | 11/2005 | Matsuba et al. | 347/33 |
| 2006/0109302 | A1 | 5/2006 | Youn | |
| 2006/0227185 | A1 * | 10/2006 | Silverbrook et al. | 347/85 |
| 2007/0115318 | A1 * | 5/2007 | Nishizaki et al. | 347/33 |
| 2009/0040269 | A1 | 2/2009 | Nakajima et al. | |
| 2009/0179942 | A1 * | 7/2009 | Hibbard et al. | 347/33 |

OTHER PUBLICATIONS

Morgavi, Paul, Impika, Aubagne, France, "Modular Ink Jet Print Engine for Industrial Application, " Presentation at IS&T's NIP19 International Conference on Digital Printing Technologies, New Orlean, Oct. 2003, 31 pages.

Morgavi, Paul, Impika, Aubagne, France, "The Challenge of Integration," 12th European Ink Jet Printing Conference, Barcelona, Spain, Oct. 2004, 25 pages.

Morgavi, Paul, Impika, Aubagne, France, "Integration, What You Need to Know," Ink jet Developers Conference 2005, Geneva, Switzerland, Apr. 2005, 27 pages.

Morgavi, Paul, Impika, Aubagne, France, "Ink Jet Print Engine Integration," IS&T Digital Production Printing 2005, Amsterdam, Netherlands, May 2005, 27 pages.

Morgavi, Paul, Impika, Aubagne, France, "Ink Jet Print Engine for Digital and Analog Industrial Press," DPP 2003-Barcelona, Spain, May 2003, 8 pages.

Morgavi, Paul, Impika, Aubagne, France, "Industrial Digital Color Printing Press for the Plastic Card Industry," IS&T's NIP18: 2002 International Conference on Digital Printing Technologies, Oct. 3, 2002, 32 pages.

Morgavi, Paul, Impika, Aubagne, France, Impika Company Presentation, Ink Jet 2008 Technology Suppliers Showcase, Denver, Colorado, USA Apr. 16, 2008, 21 pages.

Morgavi, Paul, Impika, Aubagne, France, IMI Europe, Digital Printing Conferences 2007, "Panasonic Print Head Technology and Market Applications," Nov. 7th-9th, 2007, 44 pages.

Morgavi, Paul, Impika, Aubagne, France, "Impika Product Range Presentation," at the Ink Jet Technology Suppliers Showcase, Barcelona, Spain May 30-Jun. 1, 2007, 22 pages.

Morgavi, Paul, Impika, Aubagne, France, New High Throughput Applications in Industrial Ink Jet, 29th Global Ink Jet and Thermal Printing Conference, Mar. 13-15, 2006, 28 pages.

Morgavi, Paul, Impika, Aubagne, France, "Industrial Digital Color Printing Press for the Plastic Card Industry," IMI:5th Annual Digital, Industrial &Decorate Printing Conference, Oct. 31st, 2002, 33 pages. CD in duplicate.

* cited by examiner 30
34
36
34
36
52
54
53
55B
55A
51
53B
60
86

30
36
35
62,66
62,64
60
86

30
62,66
68
69
34
35
86
62,64

Cycle wiping color A

Cycle wiping color B

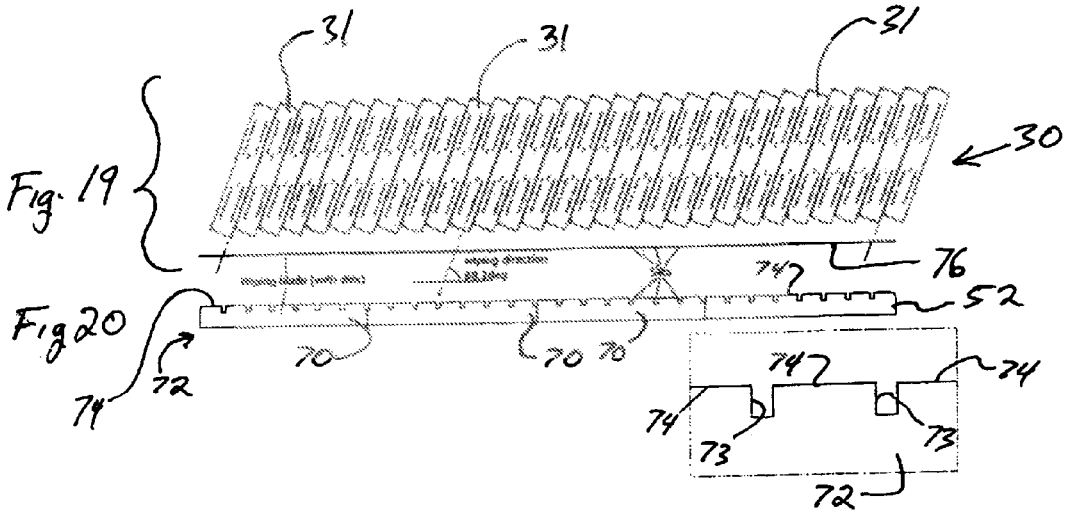
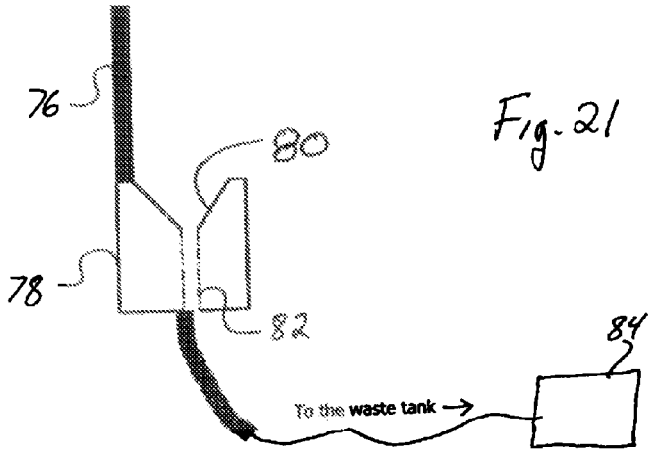
Fig. 21

MULTICOLOR PRINTHEAD MAINTENANCE STATION

FIELD OF THE INVENTION

The present invention relates to maintenance stations and, more particular, to maintenance stations for printheads including jetting modules that eject more than one liquid.

BACKGROUND OF THE INVENTION

In an inkjet printer, a line printhead includes a plurality of jetting modules, each jetting module having a nozzle plate in the form of a long narrow rectangular plate and with an array of liquid, for example, ink, ejecting nozzles. When the printhead is not in use, liquid in the nozzles and located on the nozzle plate may dry and/or attract contaminants, for example, dust or other debris, which may cause nozzle clogging and even nozzle failure resulting in decreased print quality. Maintenance stations are used to remove the liquid so as to minimize the likelihood of liquid drying in and around the nozzles of a jetting module or becoming contaminated with dust.

When jetting modules are arranged in a line printhead configuration, narrow gaps between adjacent jetting modules may also create maintenance issues. For example, wiping of the jetting modules may result in ink accumulation in the gaps between adjacent jetting modules which may drip onto a print media. Ink accumulation may also attract ink contaminants, for example, dust or other debris, which may help to clog nozzles of the jetting modules or otherwise help to reduce print quality.

EP 0799135A1 discloses a maintenance station, also referred to as a cleaning and sealing station, for a printing head. The cleaning and sealing station includes a cap unit provided with sealing chambers and means for establishing a sealing contact between the sealing chamber and the printing head. The cleaning and sealing station includes a wiping member for cleaning a main surface of each printing head. The wiping member is slidably mounted relative to the cap unit in such a manner that, during a displacement, the wiping member moves along the front of the sealing chamber. Guide means are provided for displacing the cleaning and sealing station in a direction perpendicular to the top face of the cap unit. The sealing chambers include aeration valves and means to ensure that the aeration valves are opened before the sealing chambers move away from the printing heads.

Traditionally, the jetting modules of a line printhead are configured to eject the same liquid through each jetting module. As such, the wiping units of conventional maintenance stations are configured to wipe along the entire length or width of the jetting modules of a line printhead.

However, a need exists for a maintenance station that effectively removes liquids, for example, inks, and contaminants from jetting modules of a line printhead that are configured to eject more than one type of liquid during the same printing operation.

SUMMARY OF THE INVENTION

According to one aspect of the present invention, a maintenance station apparatus for a printhead including a plurality of jetting modules disposed side by side in a row and inclined relative to a direction of print media motion, each of the plurality of jetting modules including a nozzle face, each nozzle face including a first nozzle array configured to eject a first liquid and a second nozzle array configured to eject a second liquid is provided. The maintenance station apparatus includes a wiping unit including a first wiper, a second wiper, and a wiper moving mechanism. The first wiper being associated with the first nozzle array of each jetting module and the second wiper is associated with the second nozzle array of each jetting module. The first wiper is disposed on the wiper moving mechanism such that the first wiper contacts each nozzle face at a first location between the first nozzle array and the second nozzle array of each jetting module and moves across the first nozzle array of each jetting module to a second location removed from the first nozzle array of each jetting module. The second wiper is disposed on the wiper moving mechanism such that the second wiper contacts each nozzle face at a third location between the first nozzle array and the second nozzle array of each jetting module and moves across the second nozzle array of each jetting module to a fourth location removed from the second nozzle array of each jetting module.

The maintenance station includes a capping unit including a plurality of cap pairs corresponding to the plurality of jetting modules. One cap of each cap pair is associated with the first nozzle array of the corresponding jetting module. The other cap of the cap pair is associated with the second nozzle array of the corresponding jetting module. The capping unit is moveable between the first wiper and the second wiper to a first position in which each of the plurality of cap pairs is in contact with the first nozzle array and second nozzle array of the corresponding jetting module and to a second position removed from contact with the first nozzle array and second nozzle array of the corresponding jetting module.

According to another feature of the present invention, a method of maintaining a printhead including a plurality of jetting modules disposed side by side in a row and inclined relative to a direction of print media motion, each of the plurality of jetting modules including a nozzle face, each nozzle face including a first nozzle array configured to eject a first liquid and a second nozzle array configured to eject a second liquid is provided. The method includes providing a wiping unit including a first wiper, a second wiper, and a wiper moving mechanism, the first wiper being associated with the first nozzle array of each jetting module and the second wiper being associated with the second nozzle array of each jetting module, the first wiper being disposed on the wiper moving mechanism, the second wiper being disposed on the wiper moving mechanism; causing the first wiper to contact each nozzle face at a first location between the first nozzle array and the second nozzle array of each jetting module; moving the first wiper across the first nozzle array of each jetting module to a second location removed from the first nozzle array of each jetting module; causing the second wiper to contact each nozzle face at a third location between the first nozzle array and the second nozzle array of each jetting module; and moving the second wiper across the second nozzle array of each jetting module to a fourth location removed from the second nozzle array of each jetting module.

The method can also include providing a capping unit including a plurality of cap pairs corresponding to the plurality of jetting modules, one cap of each cap pair being associated with the first nozzle array of the corresponding jetting module, the other cap of the cap pair being associated with the second nozzle array of the corresponding jetting module; and causing the capping unit to move between the first wiper and the second wiper to a first position in which each of the plurality of cap pairs is in contact with the first nozzle array and second nozzle array of the corresponding jetting module and a second position removed from contact with the first nozzle array and second nozzle array of the corresponding jetting module.

BRIEF DESCRIPTION OF THE DRAWINGS

In the detailed description of the example embodiments of the invention presented below, reference is made to the accompanying drawings, in which:

FIG. 19 is a schematic top view of the printhead of FIG. 1 showing one of the wipers of the present invention;

FIG. 20 is a schematic side view of an example embodiment of the wiper shown in FIG. 19; and FIG. 21 is a schematic side view of an example embodiment of a wiper base.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
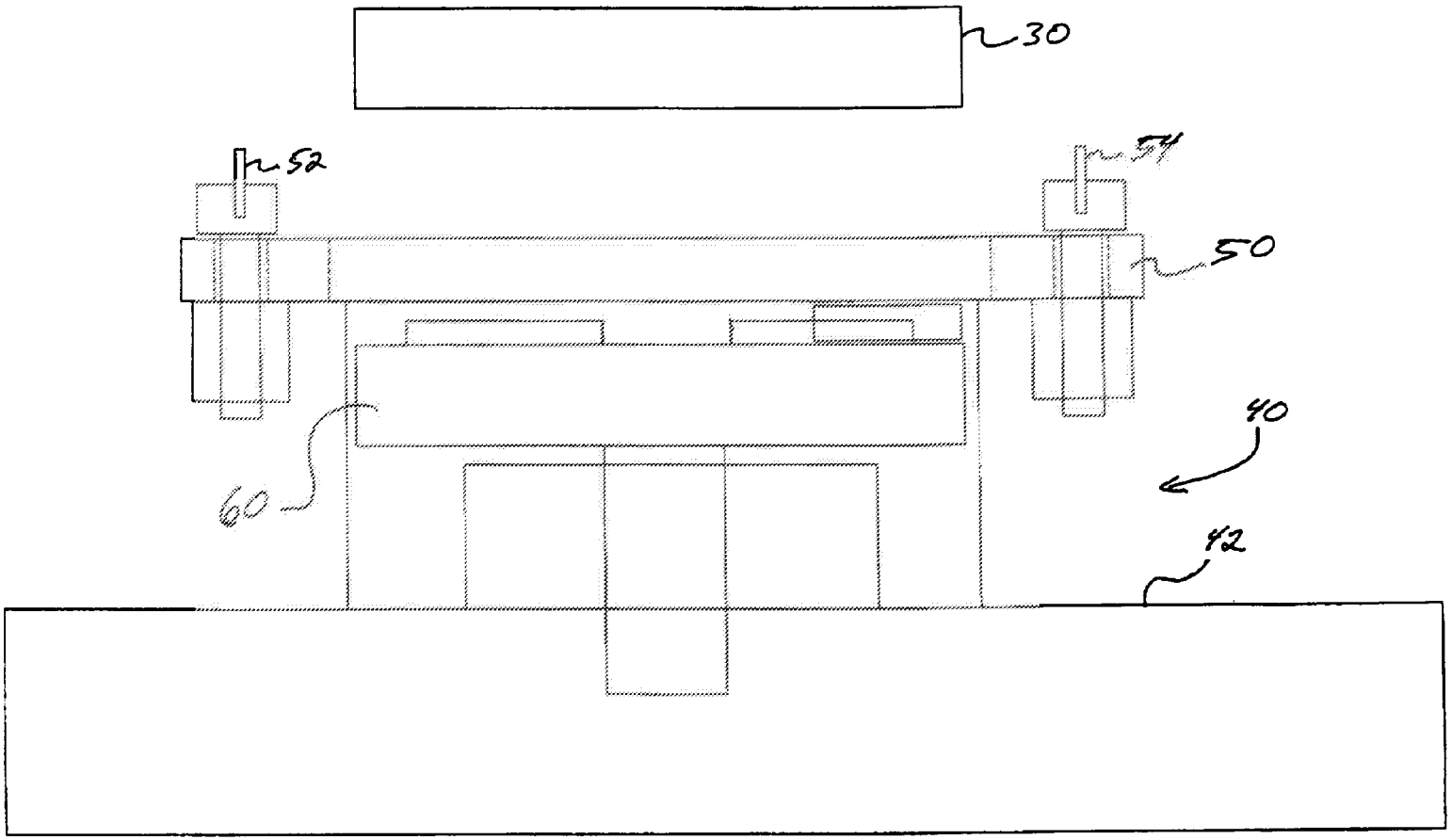
FIG. 1 is a schematic side view of an example embodiment of the present invention showing a printhead and a maintenance station in a parked position.

Referring to FIG. 1, a schematic side view of an example embodiment of the present invention showing a printhead 30 and a maintenance station 40 in a parked position is shown. Printhead 30, extending into and out of the figure, is positioned over maintenance station 40. Movement of printhead 30 is accomplished by translating printhead 30 along rails or tracks from a printing position over a print media to a position over maintenance station 40 when it is time to perform a maintenance operation. However, other movement techniques known in the art can also be used.

Maintenance station 40, also referred to as a purging wiping capping (PWC) station, includes a wiping unit 50 and a capping unit 60. Wiping unit 50 includes a first wiper 52 and a second wiper 54. Wiping unit 50 and capping unit 60 are supported by a frame structure 42 of maintenance station 40. Maintenance station 40, as shown in FIG. 1, is in a parked or home position so as to accommodate movement of printhead 30 to maintenance station 40 and movement of capping unit 60 toward printhead 30.

Typically, capping occurs before purging or prior to a temporary shut down of printhead 30 while wiping occurs after purging. Purging helps to remove air bubbles that become trapped within printhead 30 during liquid, for example, ink, filling or changing operations; clean the liquid circuit; and recover failing jets.

Figure 2:
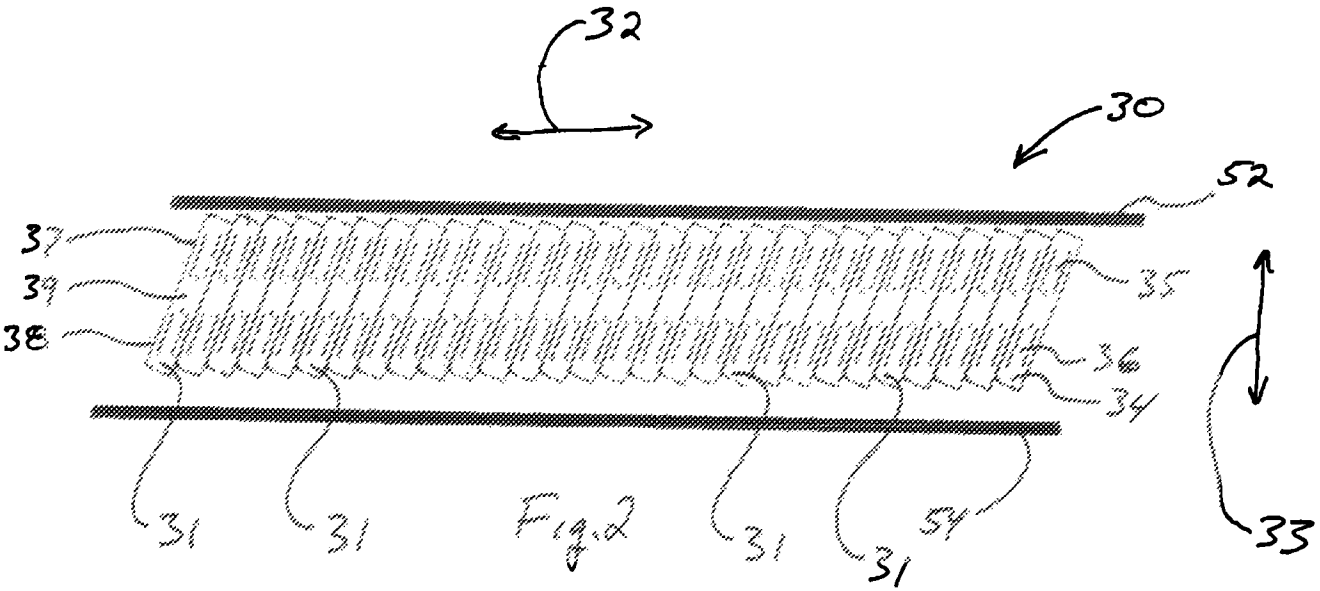
FIG. 2 is a schematic top view of the printhead of FIG. 1 showing a portion of the maintenance station.

Referring to FIG. 2, a schematic top view of printhead 30, first wiper 52, and second wiper 54 of wiping unit 50 of maintenance station 40 are shown. Printhead 30 includes a plurality of jetting modules 31 disposed side by side in a row (represented by arrow 32) and inclined relative to a direction of print media motion (represented by arrow 33). Each of the plurality of jetting modules 31 includes a nozzle face 34 with each nozzle face 34 including a first nozzle array 35 configured to eject a first liquid and a second nozzle array 36 configured to eject a second liquid. First nozzle array 35 is supplied with the first liquid, for example, a first color ink, and second nozzle array 36 is supplied with the second liquid, for example, a second color ink, independently of the other. Ejection of the first liquid through nozzle array 35 and ejection of the second liquid through second nozzle array 36 is accomplished using known techniques, for example, by using a piezoelectric actuator(s) or a heater(s). First wiper 52 is associated with first nozzle array 35 of each jetting module 31. Second wiper 54 is associated with second nozzle array 36 of each jetting module 31.

The first liquid can be a first color ink and the second liquid can be a second color ink with the first and second colors being different from each other in some aspect, for example, color, density, and viscosity. Alternatively, first and second liquids can be any printing liquids that are distinct enough from each other such that it is preferable to separately desirable to separately maintain the nozzle arrays ejecting each liquid.

In FIG. 2, first nozzle array 35 includes two rows of nozzles positioned on a first side 37 of nozzle face 34 of jetting module 31 and second nozzle array 36 includes two rows of nozzles positioned on a second side 38 of nozzle face 34 of jetting module 31. A gap 39 exists between first nozzle array 35 and second nozzle array 36.

Figure 3:
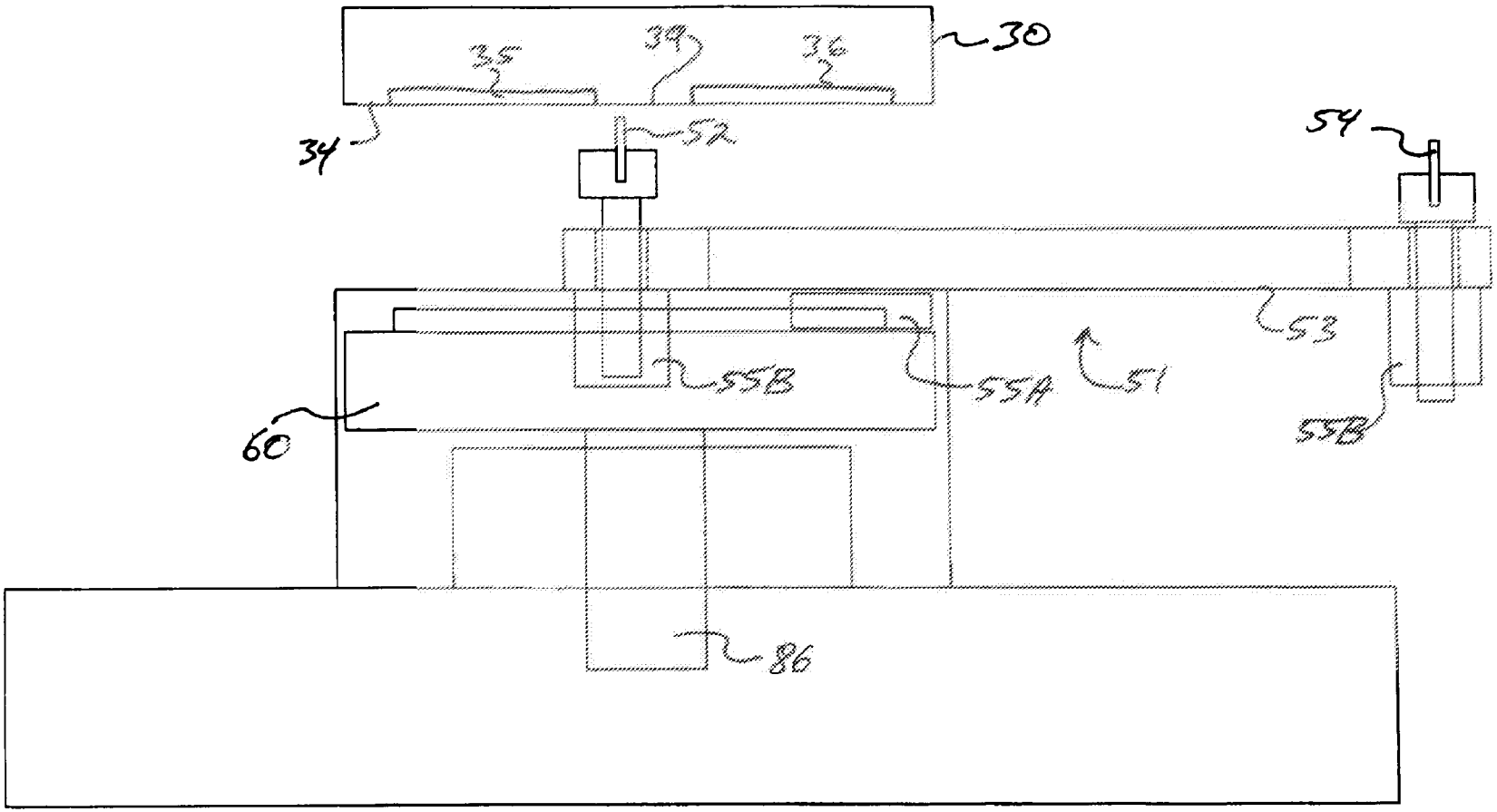
FIGS. 3-5 are schematic side views of the printhead of FIG. 1 showing a wiping unit of the maintenance station moving from the parked position shown in FIG. 1 through a partial wiping cycle of the printhead.
Figure 4:
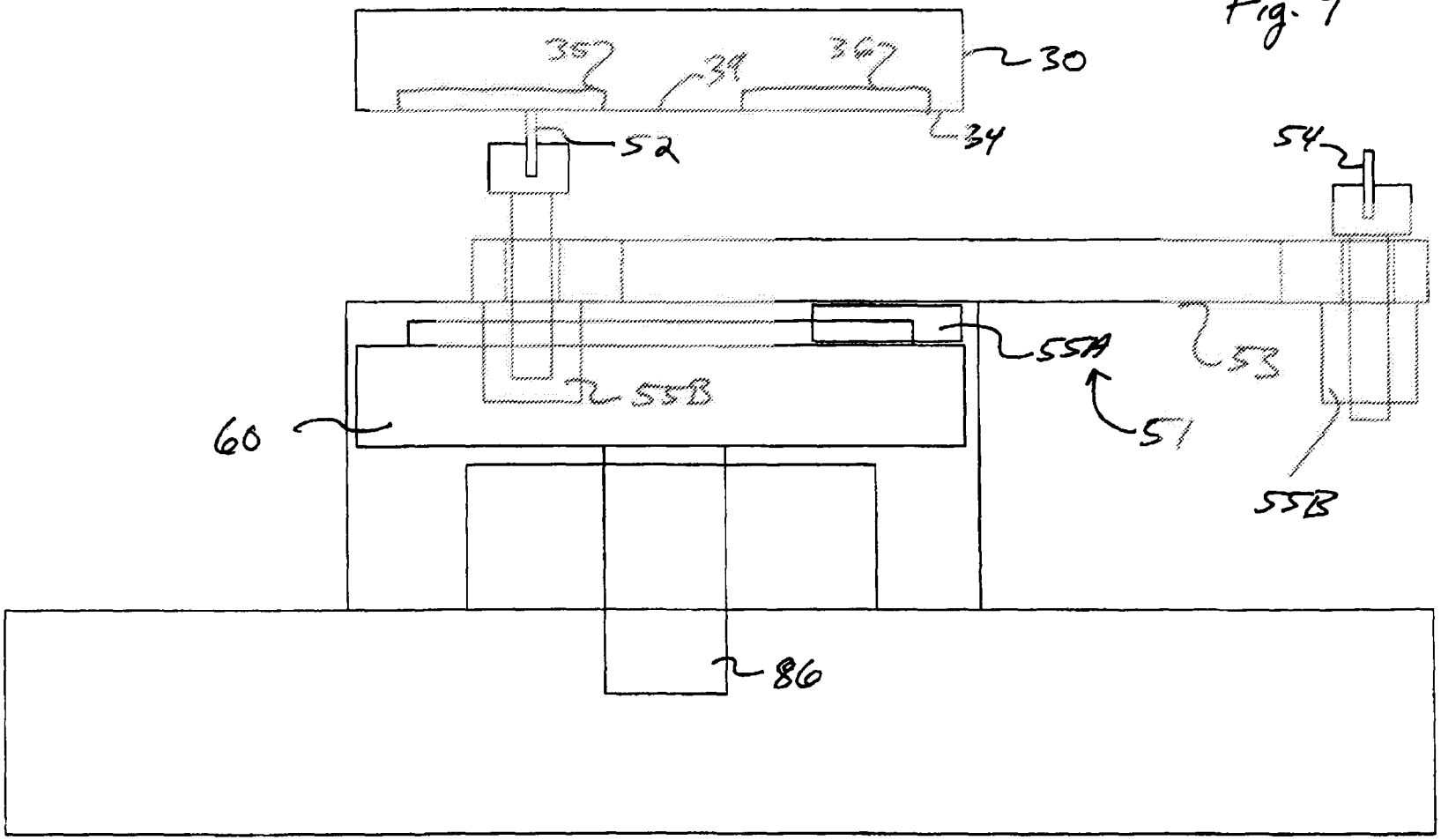
Figure 5:
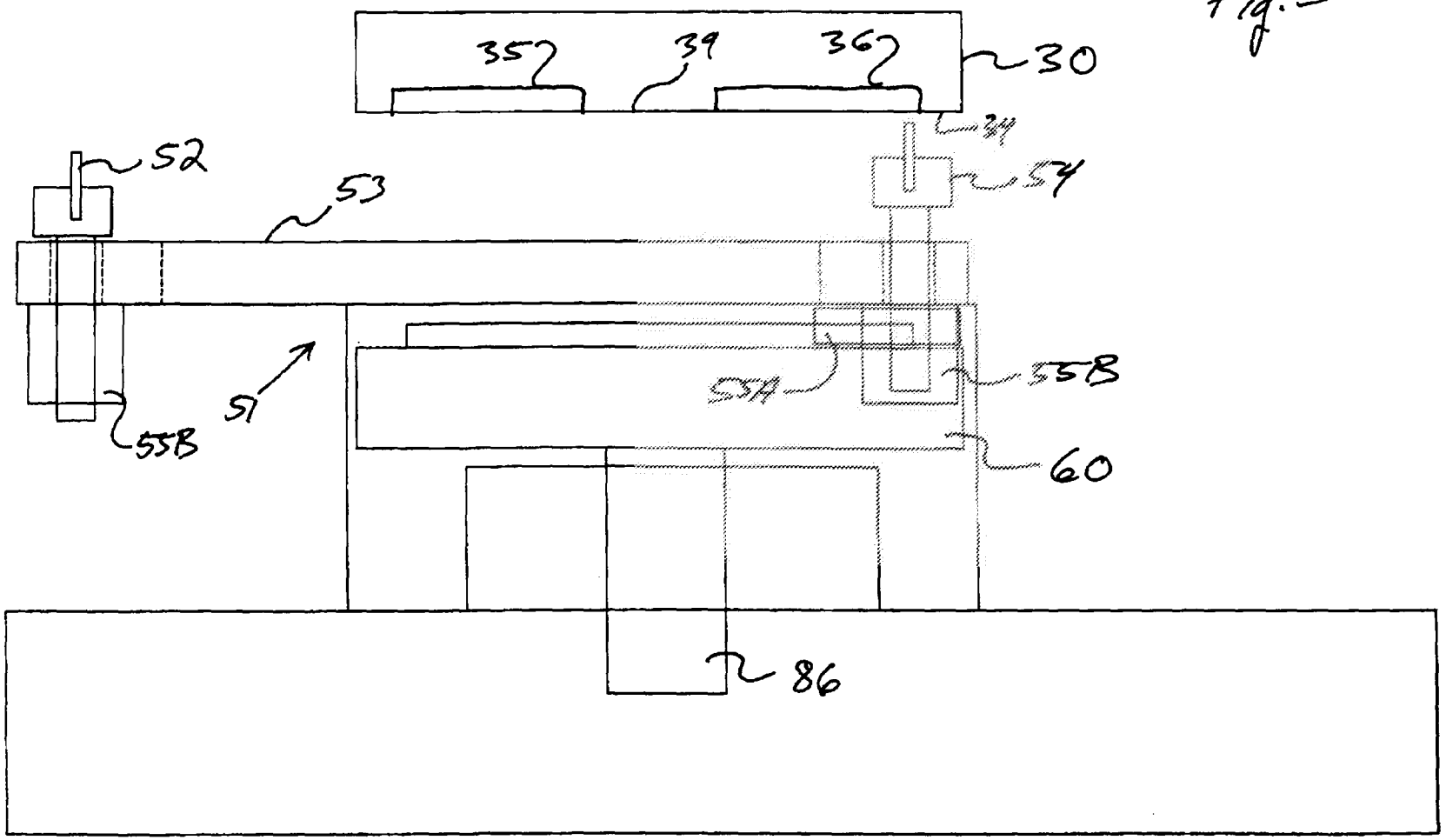

Referring to FIGS. 3-5, schematic side views of printhead 30 and wiping unit 50 of maintenance station 40 moving from the parked position shown in FIG. 1 through a partial wiping cycle of printhead 30 are shown. In addition to first wiper 52 and second wiper 54, wiping unit 50 includes a wiper moving mechanism 51.

Wiper moving mechanism 51 includes a frame 53 and an actuator(s) 55 that move first wiper 52 and second wiper 54 through a wiping cycle of printhead 30. The motion of first wiper 52 and second wiper 54 is perpendicular and lateral to the nozzle face of printhead 30 and is provided by one or more conventional actuators 55, for example, a motor or solenoid appropriately linked or geared to wiping unit 50. Wiper moving mechanism 51 can include separate actuators 55 that accomplish lateral motion, actuator 55A, and perpendicular motion, actuator 55B.

Alternatively, wiper moving mechanism 51 can include only a lateral motion actuator 55A and use the vertical actuator 86 associated with the capping unit 60 to provide perpendicular motion. This is accomplished by causing capping unit 60 to contact the wiping unit 50 and then move vertically so that first wiper 52 contacts printhead 30 as described above. Lateral motion actuator 55A then moves first wiper 52 across each first nozzle array 35. The vertical actuator associated with the capping unit 60 then lowers capping unit 60 and first wiper 52. The process is then repeated with second wiper 54.

First wiper 52 is disposed on wiper moving mechanism 51. First wiper 52 is caused by wiper moving mechanism 51 to move from its parked position (shown in FIG. 1) to a location between first nozzle array 35 and second nozzle array 36 of each jetting module 31 and removed from nozzle face 34 of each jetting module 31 (shown in FIG. 3). Wiper moving mechanism 51 causes first wiper 52 to contact each nozzle face 34 at a first location (gap 39) between first nozzle array 35 and second nozzle array 36 of each jetting module 31 (shown in FIG. 4). First wiper 52 is then caused by wiper moving mechanism 51 to move across first nozzle array 35 of each jetting module 31 to a second location removed from first nozzle array 35 of each jetting module 31 (shown in FIG. 5). First wiper 52 then returns to its home or parked position (shown in FIG. 1) without contacting first nozzle array 35.

The wiping cycle by first wiper 52 of first nozzle array 35 of each jetting module 31 is from the inside or center of each jetting module 31 to the outside edge of each jetting module 31. This wiping motion helps to reduce the likelihood of liquid accumulation in the gap 39 area of nozzle face 34. The wiping cycle of first nozzle array 35 by first wiper 52 is also shown in more detail with reference to FIGS. 8-15.

Second wiper 54 is also disposed on wiper moving mechanism 51. Wiper moving mechanism causes second wiper 54 to move from its parked position and contact each nozzle face 34 at a third location (gap 39) between first nozzle array 35 and second nozzle array 36 of each jetting module 31. Second wiper 54 is then caused by wiper moving mechanism 51 to move across second nozzle array 36 of each jetting module 31 to a fourth location removed from second nozzle array 36 of each jetting module 31.

The wiping cycle by second wiper 54 of second nozzle array 36 of each jetting module 31 is from the inside or center of each jetting module 31 to the outside edge of each jetting module 31. This wiping motion helps to reduce the likelihood of liquid accumulation in the gap 39 area of nozzle face 34. The wiping cycle of second nozzle array 36 by second wiper 54 is also shown in more detail with reference to FIGS. 8-15.

The second location removed from first nozzle array 35 of each jetting module 31 is on one side of each jetting module 31 while the fourth location removed from second nozzle array 36 of each jetting module 31 is on another side of each jetting module 31. Second wiper 54 then returns to its home or parked position (shown in FIG. 1) without contacting second nozzle array 36.

The wiping cycle by first wiper 52 of first nozzle array 35 is considered to be in a direction opposite that of the wiping cycle direction of second nozzle array 36 by second wiper 54.

Figure 6:
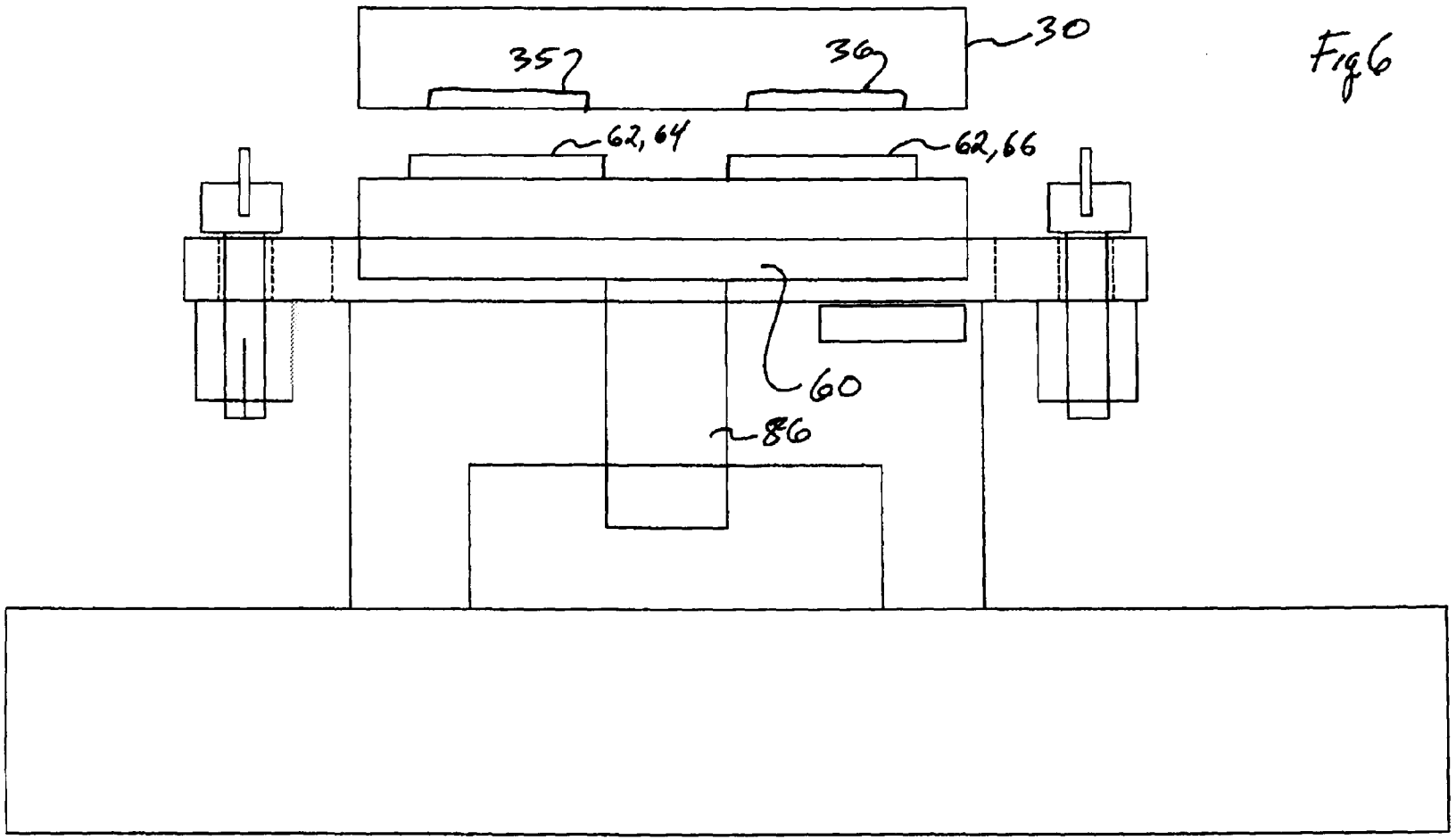
FIGS. 6 and 7 are schematic side views of the printhead of FIG. 1 showing a capping unit of the maintenance station moving from the parked position shown in FIG. 1 to a capping position.
Figure 7:
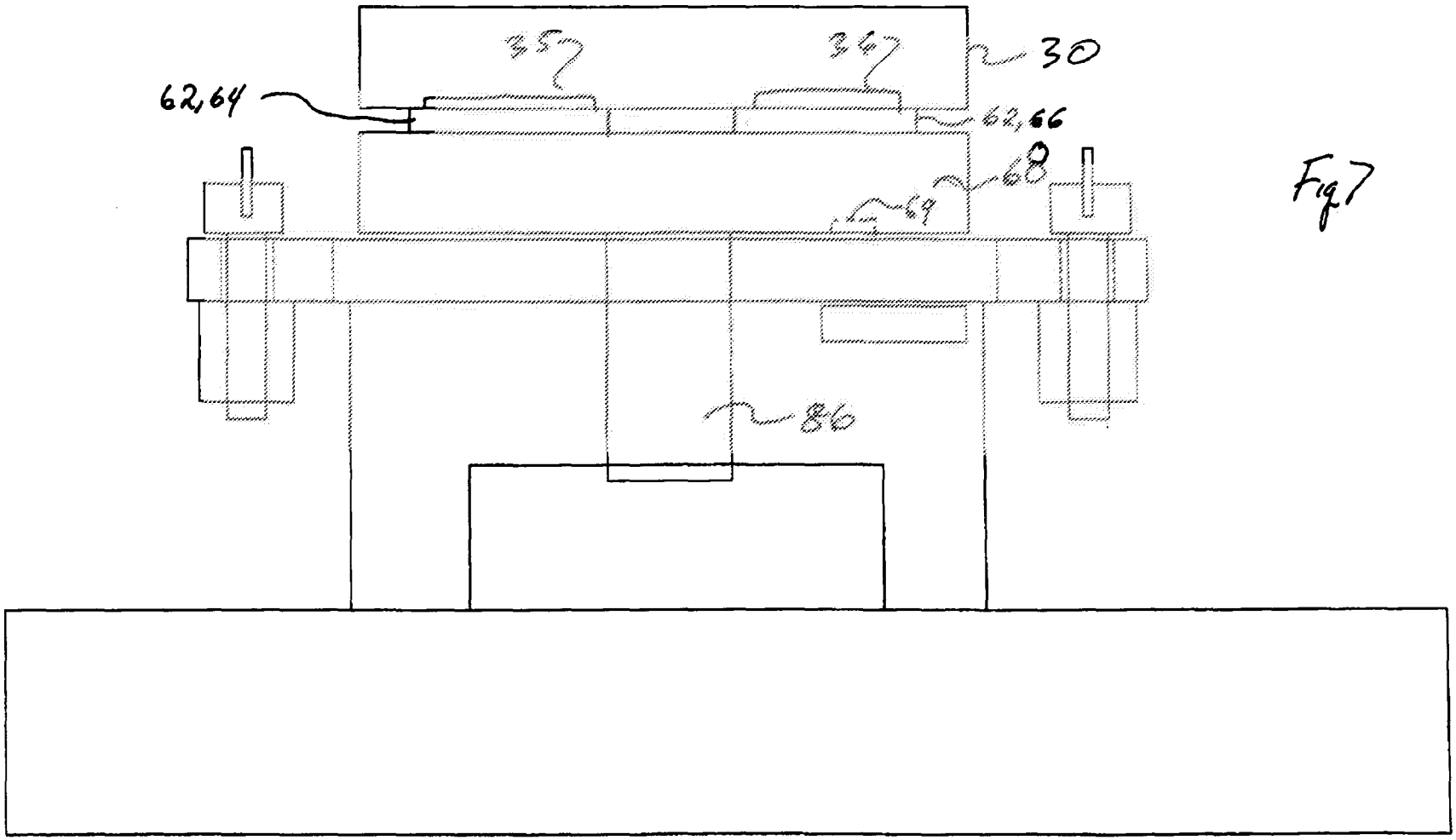

Referring to FIGS. 6 and 7, schematic side views of printhead 30 and capping unit 60 of maintenance station 40 moving from the parked position shown in FIG. 1 to a capping position are shown. Capping unit 60 includes a plurality of cap pairs 62 corresponding to the plurality of jetting modules 31 with one cap 64 of each cap pair 62 associated with first nozzle array 35 of the corresponding jetting module 31 and the other cap 66 of the cap pair 62 associated with second nozzle array 36 of the corresponding jetting module 31. Capping unit 60 is moveable between first wiper 52 and second wiper 54 to a first position in which each of the plurality of cap pairs 62 is in a sealing contact with first nozzle array 35 and second nozzle array 36 of the corresponding jetting module 31 and a second position removed from contact with first nozzle array 35 and second nozzle array 36 of the corresponding jetting module 31. The motion of capping unit 60 is perpendicular to printhead 30 and is provided by a conventional actuator 86, for example, a motor or solenoid appropriately linked or geared to capping unit 60.

A gasket made from a suitable compliant material, for example, rubber, can be provided with each cap 64 and 66 to help provide a fluidic seal with first nozzle array 35 and second nozzle array 36 of the corresponding jetting module 31. Each cap 64 and 66 or each cap pair 62 can be mounted on a spring which helps to maintain the fluidic seal with first nozzle array 35 and second nozzle array 36 of the corresponding jetting module 31.

Each cap 64, 66 of the plurality of cap pairs 62 includes a base 68 with an opening 69. Opening 69 is in fluid communication, for example, through a tube, with a waste tank (not shown) to allow for evacuation of liquid through opening 69. During capping, vacuum can be applied to each cap 64, 66 of each cap pair 62 using a puck to help suck liquid away from each first nozzle array 35 and second nozzle array 36.

When capping unit 60 is in contact with jetting modules 31, purging can occur. Purging can include providing a back pressure at the meniscus of the first liquid and the second liquid causing the liquids to be expelled from printhead 30 while each of the plurality of cap pairs 62 is in contact with the first nozzle array 35 and second nozzle array 36 of the corresponding jetting module 31 of printhead 30. The sequence of jetting module 31 purging can include purging each jetting module 31 individually, purging groups of jetting modules 31 in succession, or purging all of the jetting modules 31 simultaneously.

Wiping can occur after capping unit 60 is removed from jetting modules 31. Wiping can include providing a positive pressure at the meniscus of the first liquid and the second liquid which helps to expel the liquids during this operation. Applying a negative pressure at the meniscus of the first liquid and the second liquid which helps to draw the liquids back into each nozzle after the wiping operation is complete.

Referring to FIGS. 8-15, schematic side views of printhead 30 and another example embodiment of wiping unit 50 of maintenance station 40 moving from a parked position through a complete wiping cycle of printhead 30 are shown. In these figures, printhead 30 extends into and out of the figure. Wiper moving mechanism 51 includes a moveable frame 53 to which first wiper 52 and second wiper 54 are affixed. In this frame 53 configuration, first wiper 52 and second wiper 54 move laterally as a unit. Frame 53 includes an opening through which capping unit 60 passes through when moving from its parked position to a capping position.

Figure 8:
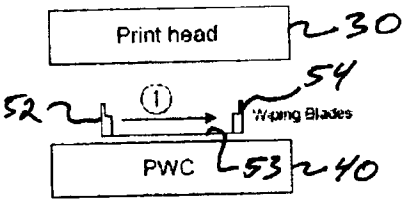
FIGS. 8-15 are schematic side views of the printhead of FIG. 1 showing another example embodiment of a wiping unit of the maintenance station moving from a parked position through a complete wiping cycle of the printhead.
Figure 9:
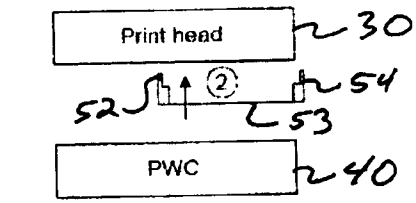
Figure 10:
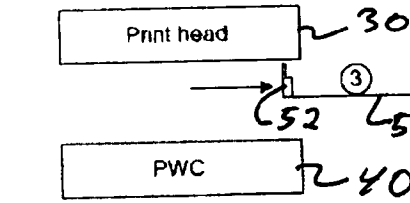
Figure 11:
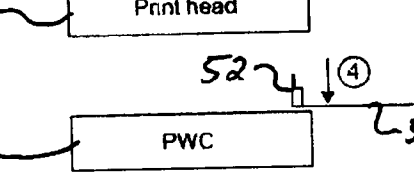

Initially, wiping unit 50 is at its home position (position 1 in FIG. 8). Wiping unit 50 moves laterally to position first wiper 52 between first nozzle array 35 and second nozzle array 36 of each corresponding jetting module 31. Wiping unit 50 moves vertically so that first wiper 52 contacts each nozzle face 34 (position 2 in FIG. 9). First wiper 52 moves across first nozzle array 35 of each jetting module 31 while maintaining contact with each first nozzle array 35 (position 3 in FIG. 10). First wiper 52 then moves away from first nozzle array 35 of each jetting module 31 toward frame 42 of maintenance station 40 to a location removed from first nozzle array 35 of each jetting module 31 (position 4 in FIG. 11).

Figure 12:
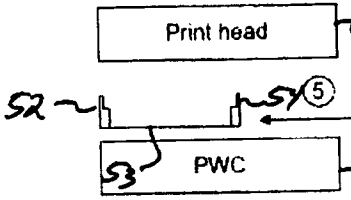
Figure 13:
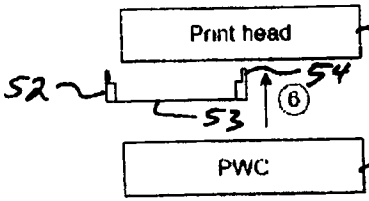
Figure 14:
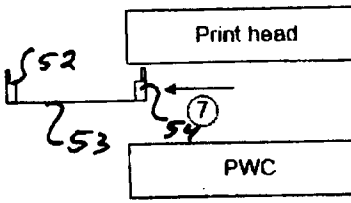
Figure 15:
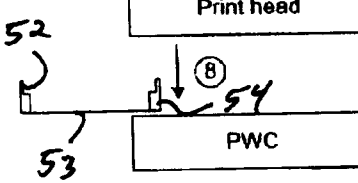

Next, wiping unit 50 moves laterally in an opposite direction to position second wiper 54 between first nozzle array 35 and second nozzle array 36 of each corresponding jetting module 31 (position 5 in FIG. 12). Wiping unit 50 then moves vertically so that second wiper 54 contacts each nozzle face 34 (position 6 in FIG. 13). Second wiper 54 moves across second nozzle array 36 of each jetting module 31 while maintaining contact with each second nozzle array 36 (position 7 in FIG. 14). Second wiper 54 then moves away from second nozzle array 36 of each jetting module 31 toward frame 42 of maintenance station 40 to a location removed from first nozzle array 35 of each jetting module 31 (position 8 in FIG. 15), ultimately, wiper unit 50 returns to its home position (position 1 in FIG. 8).

Figures 16, 17, 18:
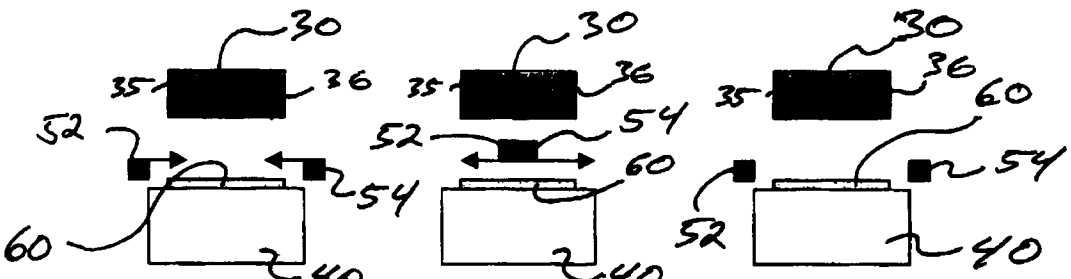
FIGS. 16-18 are schematic side views of the printhead of FIG. 1 showing another example embodiment of a wiping unit of the maintenance station moving from a parked position through a complete wiping cycle of the printhead.

Referring to FIGS. 16-18, schematic side views of printhead 30 and another example embodiment of a wiping unit 50 of maintenance station 40 moving from a parked position through a complete wiping cycle of printhead 30 are shown. In this example embodiment, first wiper 52 and second wiper 54 move from a home position (FIG. 16) to a location between first nozzle array 35 and second nozzle array 36 (FIG. 17). The movement of first wiper 52 and second wiper 54 can occur either in series or in parallel. First wiper 52 wipes first nozzle array 35 and second wiper 54 wipes second nozzle array 36 as described above. After the wiping cycle is complete, first wiper 52 and second wiper 54 return to their respective home positions.

Referring to FIG. 19, a schematic top view of printhead 30 and first wiper 52 is shown. And, referring to FIG. 20, a schematic side view of an example embodiment of first wiper 52, also shown in FIG. 19, is shown. First wiper 52 is positioned parallel to the row of jetting modules 31. Second wiper 54 can also be positioned in the same manner. First wiper 52 (and second wiper 54) are moveable in the direction of the inclination of the plurality of jetting modules 31 by wiper moving mechanism 51. First wiper 52 (and second wiper 54) is a blade type 76 wiper that continuously spans the length of printhead 30.

Optionally, first wiper 52 (and second wiper 54) includes a plurality of wiper blades 70 that span the row of jetting modules 31. Additionally, or alternatively, first wiper 52 (and second wiper 54) includes a segmented or notched wiper blade 72 with each segment 74 being contactable only with the first nozzle array 35 (second nozzle array 36) of the corresponding jetting module 31. Each segment 74 of segmented wiper blade 72 can be positioned parallel to the row of jetting modules 31. Additionally, notch 73 is positioned in the areas between first nozzle arrays 35 (second nozzles arrays 36) so as to minimize liquid accumulation in these areas during wiping. Wiper blades 70 and 72 accomplish wiping by deforming slightly after contacting nozzle face 34. Typically, wiper blades 70 and 72 are made from a suitable elastically deformable material, for example, a rubber material having an appropriate hardness and environmental compatibility.

Referring to FIG. 21, a schematic side view of an example embodiment of a wiper base is shown. In this embodiment, first wiper 52 includes a blade type wiper 76 affixed to a wiper blade base 78. Wiper blade base 78 includes a catch basin 80 to collect liquid from wiper 76. Catch basin 80 leads to a drain 82 that is in fluid communication with a waste tank 84. Catch basin 80 spans the length of wiper base 76. However, other configurations of catch basin 80 are permitted and depend on the specific type of wiper being used.

The invention has been described in detail with particular reference to certain preferred embodiments thereof, but it will be understood that variations and modifications can be effected within the scope of the invention.

PARTS LIST

30 printhead
31 plurality of jetting modules
32 arrow
33 arrow
34 nozzle face
35 first nozzle array
36 second nozzle array
37 first side
38 second side
39 gap
40 maintenance station
42 frame structure
51 wiper moving mechanism
52 first wiper
53 frame
54 second wiper
55 actuator(s)
62 plurality of cap pairs
64 one cap
66 other cap
68 base
69 opening
70 plurality of wiper blades
72 segmented wiper blade
74 each segment
76 blade type wiper
78 wiper blade base
82 drain
84 waste tank
86 actuator

The invention claimed is:

1. A maintenance station apparatus for a printhead including a plurality of jetting modules disposed side by side in a row and inclined relative to a direction of print media motion, each of the plurality of jetting modules including a nozzle face, each nozzle face including a first nozzle array configured to eject a first liquid and a second nozzle array configured to eject a second liquid, the maintenance station apparatus comprising:

a wiping unit including a first wiper, a second wiper, and a wiper moving mechanism, the first wiper being associated with the first nozzle array of each of the plurality of jetting modules and the second wiper being associated with the second nozzle array of each of the plurality of jetting modules, the first wiper being disposed on the wiper moving mechanism such that the first wiper contacts all of the nozzle faces at a first location on each of the nozzle faces between the first nozzle array and the second nozzle array of each of the plurality of jetting modules and moves across the first nozzle array of each of the plurality of jetting modules to a second location removed from the first nozzle array of each of the plurality of jetting modules, the second wiper being disposed on the wiper moving mechanism such that the second wiper contacts each nozzle face at a third location between the first nozzle array and the second nozzle array of each of the plurality of jetting modules and moves across the second nozzle array of each of the plurality of jetting module to a fourth location removed from the second nozzle array of each of the plurality of jetting modules;

a capping unit including a plurality of cap pairs each corresponding to one of the plurality of jetting modules, one cap of each cap pair being associated with the first nozzle array of the corresponding jetting module, the other cap of the cap pair being associated with the second nozzle array of the corresponding jetting module, the capping unit being moveable between the first wiper and the second wiper to a first position in which each of the plurality of cap pairs is in contact with the first nozzle array and second nozzle array of the corresponding jetting module and a second position removed from contact with the first nozzle array and second nozzle array of the corresponding jetting module; and wherein the wiper moving mechanism includes a moveable frame to which the first wiper and the second wiper are affixed, and wherein the moveable frame includes an opening between the first wiper and the second wiper wherein the capping unit and the plurality of cap pairs are all moveable between the first wiper and the second wiper through the opening of the frame.

2. The apparatus according to claim 1, wherein the wiper moving mechanism includes a moveable frame to which the first wiper and the second wiper are affixed such that the first wiper and the second wiper move laterally as a unit.

3. The apparatus according to claim 1, wherein the first wiper includes a plurality of wiper blades that span the row of jetting modules.

4. The apparatus according to claim 1, wherein the first wiper includes a segmented wiper blade, each segment being contactable only with the first nozzle array of the corresponding jetting module.

5. The apparatus according to claim 4, wherein each segment of the segmented wiper blade is positioned parallel to the row of jetting modules.

6. The apparatus according to claim 1, wherein first wiper and the second wiper are moveable in the direction of the inclination of the plurality of jetting modules.

7. The apparatus according to claim 6, wherein the direction of the inclination is along a straight line extending between the first and second nozzle arrays of each of the plurality of jetting modules.

8. The apparatus according to claim 1, wherein each cap of the plurality of cap pairs includes a base with an opening, the opening being in fluid communication with a waste tank to allow for evacuation of liquid through the opening.

9. The apparatus according to claim 1, wherein the first liquid is a first color ink and the second liquid is a second color ink.

10. The apparatus according to claim 1, wherein each nozzle face is a planar nozzle face, the first nozzle array is disposed proximate a first end of each nozzle face, the second nozzle array is disposed proximate a second end of each nozzle face, and wherein the second end of each nozzle face is opposite the first end of each nozzle face.

11. The apparatus according to claim 1, wherein the first wiper, the second wiper, and the row of jetting modules are all disposed in parallel with each other, and wherein a length of the first wiper and the second wiper is at least as long as the row of jetting modules.

12. The apparatus according to claim 1, wherein the plurality of cap pairs are arranged in two rows across the capping unit.

13. The apparatus according to claim 1, wherein the first wiper comprises a first main unitary body having first notches for defining a plurality of first wiper segments therebetween, each of the first wiper segments corresponding to the first nozzle array of one of the plurality of jetting modules for wiping the one corresponding first nozzle array.

14. The apparatus according to claim 13, wherein the second wiper comprises a second main unitary body having second notches for defining a plurality of second wiper segments therebetween, each of the second wiper segments corresponding to the second nozzle array of one of the plurality of jetting modules for wiping the one corresponding second nozzle array.

15. The apparatus according to claim 1, further comprising a single actuator for providing perpendicular motion for the capping unit and for the first and second wipers, the perpendicular motion for moving the capping unit and the first and second wipers directly toward the printhead and directly away from the printhead.

16. A method of maintaining a printhead including a plurality of jetting modules disposed side by side in a row and inclined relative to a direction of print media motion, each of the plurality of jetting modules including a nozzle face, each nozzle face including a first nozzle array configured to eject a first liquid and a second nozzle array configured to eject a second liquid, the method comprising:

providing a wiping unit including a first wiper, a second wiper, and a wiper moving mechanism, the first wiper being associated with the first nozzle array of each jetting module and the second wiper being associated with the second nozzle array of each jetting module, the first wiper being disposed on the wiper moving mechanism, the second wiper being disposed on the wiper moving mechanism;

causing the first wiper to contact each nozzle face at a first location between the first nozzle array and the second nozzle array of each jetting module;

moving the first wiper across the first nozzle array of each jetting module to a second location removed from the first nozzle array of each jetting module;

causing the second wiper to contact each nozzle face at a third location between the first nozzle array and the second nozzle array of each jetting module;

moving the second wiper across the second nozzle array of each jetting module to a fourth location removed from the second nozzle array of each jetting module; and providing a capping unit including a plurality of cap pairs corresponding to the plurality of jetting modules, one cap of each cap pair being associated with the first nozzle array of the corresponding jetting module, the other cap of the cap pair being associated with the second nozzle array of the corresponding jetting module; and causing the capping unit and the plurality of cap pairs to move between the first wiper and the second wiper such that the plurality of cap pairs are all between the first wiper and the second wiper.

17. The method according to claim 16, further comprising:

causing the capping unit to move between the first wiper and the second wiper to a first position in which each of the plurality of cap pairs is in contact with the first nozzle array and second nozzle array of the corresponding jetting module and a second position removed from contact with the first nozzle array and second nozzle array of the corresponding jetting module.

18. The method according to claim 17, further comprising:

purging the printhead of the first liquid and the second liquid by applying a vacuum to the capping unit while each of the plurality of cap pairs is in contact with the first nozzle array and second nozzle array of the corresponding jetting module of the printhead.

19. The method according to claim 17, further comprising:

purging the printhead of the first liquid and the second liquid while each of the plurality of cap pairs is in contact with the first nozzle array and second nozzle array of the corresponding jetting module of the printhead.

* * * * *